United States Patent [19]

Tomasetti et al.

[11] 4,341,427

[45] Jul. 27, 1982

[54] METHOD FOR STABILIZING THE ANODE SENSITIVITY OF A PHOTOMULTIPLIER TUBE

[75] Inventors: Charles M. Tomasetti, Leola; Maurice D. Harsh; Arthur F. McDonie, both of Lancaster, all of Pa.

[73] Assignee: RCA Corporation, New York, N.Y.

[21] Appl. No.: 164,675

[22] Filed: Jun. 30, 1980

[51] Int. Cl.[3] ..... H01J 9/12; H01J 9/00

[52] U.S. Cl. ..... 316/1

[58] Field of Search ..... 316/1, 27; 313/95, 96, 313/104, 105

[56] References Cited

U.S. PATENT DOCUMENTS

| | | | |
|---|---|---|---|
| 2,237,242 | 4/1941 | Tykociner et al. | 316/1 X |
| 2,676,282 | 4/1954 | Polkosky | 313/95 X |
| 2,952,499 | 9/1960 | Carson | 316/1 |
| 3,251,640 | 5/1966 | Wennin | 316/1 |
| 3,535,011 | 10/1970 | Matheson et al. . | |
| 3,649,868 | 3/1972 | Bensussan | 313/104 X |
| 3,966,287 | 6/1976 | Liller | 316/1 |
| 4,099,079 | 7/1978 | Knapp | 313/95 X |

OTHER PUBLICATIONS

RCA Photomultiplier Manual, PT61, p. 43, 1970.

*Primary Examiner*—Gil Weidenfeld
*Assistant Examiner*—Fred A. Silverberg
*Attorney, Agent, or Firm*—Eugene M. Whitacre; Dennis H. Irlbeck; Vincent J. Coughlin, Jr.

[57] ABSTRACT

A method is described for stabilizing the anode sensitivity of a photomultiplier tube having a photocathode, an anode, and a plurality of dynodes including at least one Nichrome dynode adjacent to the anode. The steps include differentially heating the tube so that the temperature of the Nichrome dynodes and the anode is substantially greater than the photocathode. The temperature gradient established by the differential heating redistributes alkali material from the surface of the dynodes in a beneficial manner so as to balance the secondary emission gain of the dynodes so that decrease in Nichrome dynode gain is offset by increases in the gain of the other dynodes. The tube is then bright aged at a first voltage followed by a dark age at a higher voltage. The aging steps rearrange or rebind the remaining loosely bound alkali material to provide an increase in anode sensitivity stability.

10 Claims, 5 Drawing Figures

METHOD FOR STABILIZING THE ANODE SENSITIVITY OF A PHOTOMULTIPLIER TUBE

BACKGROUND OF THE INVENTION

The invention relates to a photomultiplier tube and particularly to a method for stabilizing the anode sensitivity of the tube.

The loss of anode sensitivity, commonly described as tube fatigue, is a function of anode current level, dynode material and previous tube operating history.

The sensitivity changes that are a direct function of high anode currents imposed for extended lengths of time are believed to be the result of erosion or rearrangement of the alkali material from the dynode surfaces during periods of heavy electron bombardment and the subsequent deposition of the alkali material on the other areas within the photomultiplier tube. Sensitivity losses of this type may be reversed during periods of non-operation when the alkali material may again return to the dynode surfaces. This process of return may be accelerated by heating the photomultiplier tube during periods of non-operation to a temperature within the maximum temperature rating of the tube.

Sensitivity losses for a given operating current usually occur rather rapidly during initial operation and at a much slower rate after the tube has been used for some time. Tubes operated at lower anode current levels, of the order of 10 microamperes or less, experience less fatigue than those operated at higher currents.

Fatigue rates are also affected by the type of dynode material used in the tube. Beryllium-copper or silver-magnesium dynodes are generally more stable at high operating currents than alkali antimonide dynodes. It has been observed that the anode sensitivity for tubes utilizing beryllium-copper dynodes and silver-magnesium dynodes very often increases during the initial hours of operation, after which a gradual decrease in sensitivity takes place.

In many photomultiplier tube applications, particularly where more than one photomultiplier tube is used, the above-described sensitivity changes are objectionable. For example, in gamma camera systems which typically utilize as many as 37 photomultiplier tubes, the problem of anode sensitivity changes is especially troublesome since tube-to-tube variations in sensitivity are difficult to control. In such systems the maximum anode sensitivity changes that can be tolerated are within the range of ±10% for each tube.

In photomultiplier tubes such as the RCA 4879A used in some gamma camera systems a plurality of beryllium-copper dynodes such as those described in the copending patent application, Ser. No. 132,659, filed Mar. 21, 1980, by Faulkner et al., assigned to the same assignee as the present invention and incorporated by reference herein, are used. An improved secondary emission surface of the primary dynode in the above-mentioned Faulkner et al. application provides a greater number of secondary electrons for each primary electron incident thereon. The higher electron gain from the first dynode results in a greater flux of electrons incident on subsequent dynodes in the electron multiplier array with a resulting increase in anode current and a correspondingly greater change in anode sensitivity.

SUMMARY OF THE INVENTION

A method of stabilizing the anode sensitivity of a photomultiplier tube having a photocathode, an anode and a plurality of dynodes including at least one Nichrome dynode adjacent to the anode, includes the following steps. A temperature gradient is established across the plurality of dynodes so that the temperature of the Nichrome dynode and the anode is substantially greater than the temperature of the photocathode. The tube is then aged at a first voltage for a predetermined period of time with the photocathode illuminated. Finally, the tube is aged at a second voltage for a second predetermined period of time with no illumination incident on the photocathode.

DESCRIPTION OF THE PREFERRED EMBODIMENT

Figure 1:
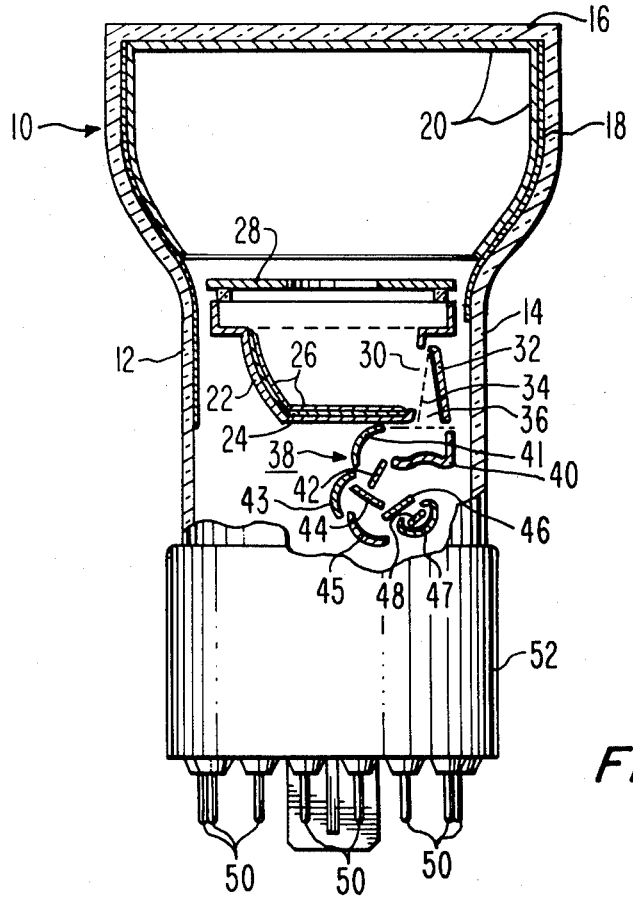
FIG. 1 is a partial cross-sectional view of a photomultiplier tube processed by the present method so as to stabilize the anode sensitivity.

Referring to FIG. 1, there is shown a photomultiplier tube 10 comprising an envelope 12 having a generally cylindrical sidewall 14 and a faceplate 16. An aluminizing coating 18 is disposed on a portion of the sidewall 14 adjacent to the faceplate 16. Within the tube 10 is a photocathode 20 on the faceplate 16 and also along a portion of the aluminum coating 18 on the sidewall 14. The portion of the photocathode 20 on the faceplate 16 is transparent while the portion of the photocathode 20 along the aluminum coating 18 is of a reflective type. The photocathode 20 may be potassium-cesium antimonide, for example, or any one of a number of photoemissive materials well known in the art. Inside the tube 10 is a primary or first teacup dynode 22 preferably of a beryllium-copper material having an active oxide secondary emissive surface 24 such as beryllium oxide, for example, which faces the faceplate 16. A substantially uniform layer 26 of an alkali antimonide compound, such as potassium-cesium-antimonide, may overlie the coating 24 as disclosed in the above-referenced Faulkner et al. copending patent application. An apertured focusing electrode 28 is disposed in spaced relation between the teacup dynode 22 and the transparent portion of photocathode 20 on the faceplate 16. The teacup dynode 22, as described in the Faulkner et al. copending patent application, has an output aperture 30 adjacent to a second dynode 32.

The second dynode 32, preferably made from beryllium-copper, acts as a receiving member for secondary electrons emitted from the teacup dynode 22. The second dynode 32 has an input aperture 34 and an output aperture 36. Secondary electrons emitted from the beryllium oxide secondary emissive surface of the second dynode 32, pass through the output aperture 34, and serve as primary electrons which impinge upon a chain or array 38 of eight beryllium-copper dynodes, consecutively numbered 40 through 47 inclusive, and an anode 48. The anode 48 is partially surrounded by an anode shield or final dynode 47 of the array 38. Each of the dynodes 40 through 47 have a beryllium oxide secondary emissive surface.

While a total of ten dynodes may be utilized in the above-described embodiment for propagating and concatenating electron emission from the photocathode 20 to the anode 48, it is clear to one skilled in the art that additional dynodes may either be included between the second dynode 32 and the anode 48 or dynodes may be eliminated from the array. The total number of dynodes is governed, among other things, by the final gain desired from the tube.

Evaporator assemblies (not shown) are provided to activate the secondary emissive surface of the dynodes and to form the photocathode. Such evaporators are described, for example, in the above-mentioned Faulkner et al. copending patent application.

The dynodes 22, 32, and 40 through 47, the focusing electrode 28, the photocathode 20 and the anode 48 have conductive wires attached thereto for placing electrostatic charges thereon. The wires (not shown) terminate at the metal pins 50 located at the base 52 of the tube 10. As so far described, the photomultiplier tube 10 having a teacup primary dynode is known, per se, in the prior art.

In an attempt to minimize the anode sensitivity changes described herein, it is known in the art to activate the tube with the optimum quantity of alkali material and to bake the activated tube for a period of time sufficient to remove as much of the excess alkali material as is possible prior to separating the tube from the vacuum system which is used throughout the activation process to evacuate the tube. Subsequent to activation, the tube is usually baked with the entire electron multiplier array 38 and the anode 48 subjected to a temperature in excess of that of the photocathode in order to reduce the background noise or "dark current" of the tube by redistributing any remaining excess alkali material from the structural elements of the multiplier array such as the dynode support rods (not shown) and support spacers (not shown) as well as from the wall of the tube to the cooler regions of the tube, preferably the photocathode.

In the above-described tube structure having a primary dynode 22 with an alkali antimony layer 26 overlying the beryllium oxide surface 24, the maximum dark current reducing bake temperature of the primary dynode 22 must be less than the bake temperature of the beryllium-copper dynodes 40 through 47 which may, for example, be as high as 225° C., since such a high temperature will reduce the secondary emission gain of the primary dynode 22 to an unsatisfactorily low level. To achieve the required temperature distribution the primary dynode must be maintained at a temperature between that of the dynode array 38 and the photocathode 20.

After the above-described bake to reduce dark current, the tube 10 is bright aged, i.e. operated with the photocathode illuminated for a predetermined time and at a predetermined voltage and, then dark aged by removing the illumination from the photocathode. The purpose of the aging steps is to stabilize the anode sensitivity of the tube by electron scrubbing the remaining excess alkali material from the surface of the dynodes. The aging process may also induce a rearrangement or rebinding of loosely bound alkali material to the dynode surface.

Figure 3:
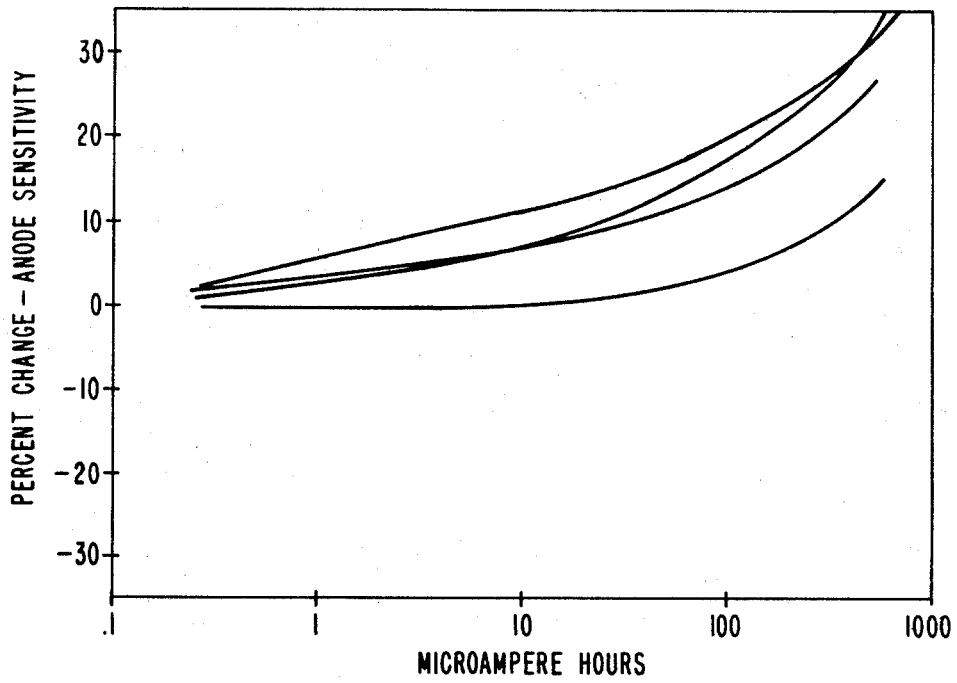
FIG. 3 is a graph showing the change in anode sensitivity as a function of anode current and time for a set of prior art tubes comprising beryllium-copper dynodes which had the entire dynode array differentially baked and subsequently aged.

The results of the anode stability test of four tubes constructed, processed, baked and aged as described above is shown in FIG. 3. The ordinate of FIG. 3 reflects the percentage change in anode sensitivity from an initial value. The abscissa shows the anode current-time relationship expressed in microampere-hours. Each of the four test tubes were operated at a nominal initial 10 microamperes of anode current. The illumination for the stability test is proved by a feedback controlled constant intensity LED light source. As shown in FIG. 3 the prior art tubes increased in anode sensitivity ranging from 15 to more than 35 percent in about 600 microampere-hours. At the termination of the test all of the tubes showed an increasing trend in anode sensitivity. Such a condition is unacceptable since differences in rates of increase in an array of tubes cannot be tolerated in a multi-tube system such as a gamma camera system.

An alternative approach to improving the stability of the anode sensitivity is described in the copending patent application, Ser. No. 134,276 filed Mar. 26, 1980 by Tomasetti et al., and assigned to the assignee of the present invention and incorporated by reference herein. In the Tomasetti et al. structure an RCA 4840 side-on photomultiplier tube having an alkali antimonide dynode array has the final alkali antimonide dynode, i.e., the dynode immediately adjacent to the anode in the electron multiplier array, replaced by a Nichrome dynode. As described in the copending Tomasetti et al. application, the Nichrome dynode is substantially non-reactive to alkali materials and thus the final dynode of the activated tube is substantially devoid of secondary emissive materials. Any alkali material that is deposited on the Nichrome surface of the final dynode can be removed by "aging" the tube as described in the copending application.

In the present preferred tube structure the ninth dynode 46 and the tenth or final dynode 47, disclosed to be formed from beryllium-copper in the prior art, comprise a nickel based alloy containing chromium such as, for example, Nichrome. The Nichrome dynodes 46 and 47 are prepared in a manner disclosed in the Tomasetti et al. copending patent application referenced above, so as to be substantially non-reactive to the alkali vapors generated within the tube 10 during the activation of the beryllium-copper dynodes and the photocathode. While Nichrome is preferred, other materials that will be suitably non-reactive with alkali vapors may also be used.

Two modified 4879A photomultiplier tubes having the last two beryllium-copper dynodes, 46 and 47 respectively, in the electron multiplier array 38 replaced with Nichrome dynodes were constructed, processed and aged by the method described in the Tomasetti et al. application. As a control, a pair of standard 4879A tubes having beryllium-copper dynodes in the electron multiplier array were similarly processed and aged.

Figure 4:
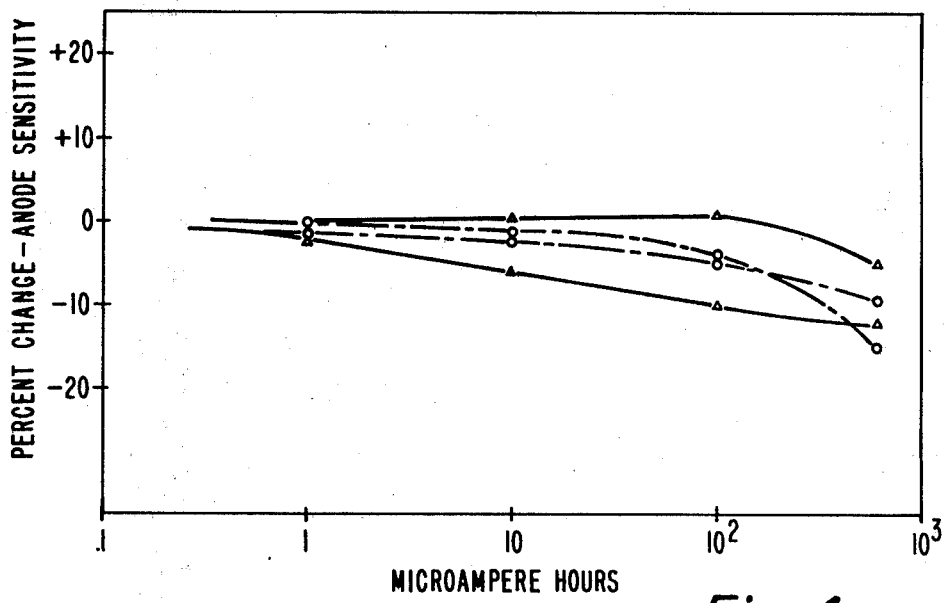
FIG. 4 is a graph showing the change in anode sensitivity as a function of anode current and time for a pair of prior art tubes comprising beryllium-copper dynodes and a pair of tubes comprising copper-beryllium dynodes with the two dynodes immediately adjacent to the anode comprising Nichrome. All of the tubes were aged but not differentially baked.

According to the teaching of the Tomasetti et al. copending patent application the present structure, after aging, was expected to demonstrate excellent anode current stability and thus little change in anode sensitivity. The results, as shown in FIG. 4, indicate that both the test and control tubes exhibit a decrease in anode sensitivity ranging from about 5 to 12 percent for the standard tubes, indicated by the solid curve, to about 11 to 15 percent for tubes, represented by the dashed curves, having Nichrome dynodes substituted for the last two beryllium-copper dynodes. At the termination of the anode stability test, the tubes of FIG. 4 continued to show a decreasing trend in anode sensitivity. This decrease in anode sensitivity, while within the acceptable range for the 4840 tube type, is unacceptable for the 4879A which requires a higher degree of anode stability.

An additional set of six modified 4879A tubes, all having ninth and tenth Nichrome dynodes 46 and 47 were constructed. After cathode processing, three tubes were aged according to the aging schedule described in the copending Tomasetti et al. application, Ser. No. 134,276 referenced above.

The remaining three tubes of the above-described set of tubes were differentially baked and aged by the present novel method which differs from the prior art post-exhaust process in that the differential heating concentrates the heat in the area surrounding the last two Nichrome dynodes 46 and 47, respectively, and the anode 48. Thus a temperature gradient is established across the multiplier array 38.

Figure 2:
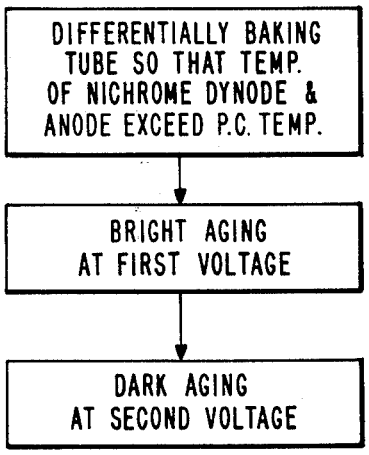
FIG. 2 is a flow chart showing the steps in the stabilization of the anode sensitivity according to the present method.

Specifically, the present novel method, outlined in FIG. 2, requires that subsequent to cathode processing and removal from the exhaust system, the tube 10 be placed in a small differential baking oven, not shown, so that the base 52, the anode 48 and the dynodes 46 and 47 may be heated, e.g., by a heating coil, to a temperature ranging from about 175° to 225° C. The tube 10 is supported in the oven so that the remaining dynodes in the dynode array 38, as well as the dynodes 32 and 22 and the photocathode 20, extend beyond the differential baking oven. The tube 10 and the differential heating oven are enclosed in a larger oven, not shown, which is maintained at a temperature ranging from about 100° C. to 140° C., although about 125° C. is preferred. In this manner a temperature gradient ranging from about 125° C. at the photocathode to between about 175° C. to about 225° C. at the anode of the tube 10 is established. The above described differential heating step is maintained for about 20 to 25 minutes. Following the differential heating step the tube is cooled to room temperature.

At room temperature the tube is energized with a voltage distribution of about 1100 volts applied to the tube elements in a manner well known in the art. A tungsten light source is placed in proximity to the photocathode 20 and adjusted in intensity until about 10 to 50 microamperes of anode current flow in tube 10. The anode current is measured by placing a microammeter in series with the anode 48 in a manner well known in the art. The tube is "bright aged," i.e., aged with the light source illuminating the photocathode, for about 4 hours.

At the end of the 4 hours the light is switched off and the voltage is increased to 1600 volts. The tube is "dark aged" for about 8 to 12 hours.

While the differential heating step was described in terms of a small differential baking oven contained within a larger oven, it is within the scope of this invention that the dynodes 46 and 47 and the anode 48 be differentially heated by other means such as by a high intensity light source focused on the dynodes and the anode, or by radiant heating such as by an Rf coil adjacent to the dynodes and the anode. By way of example, the light source may be a xenon lamp or a laser.

Figure 5:
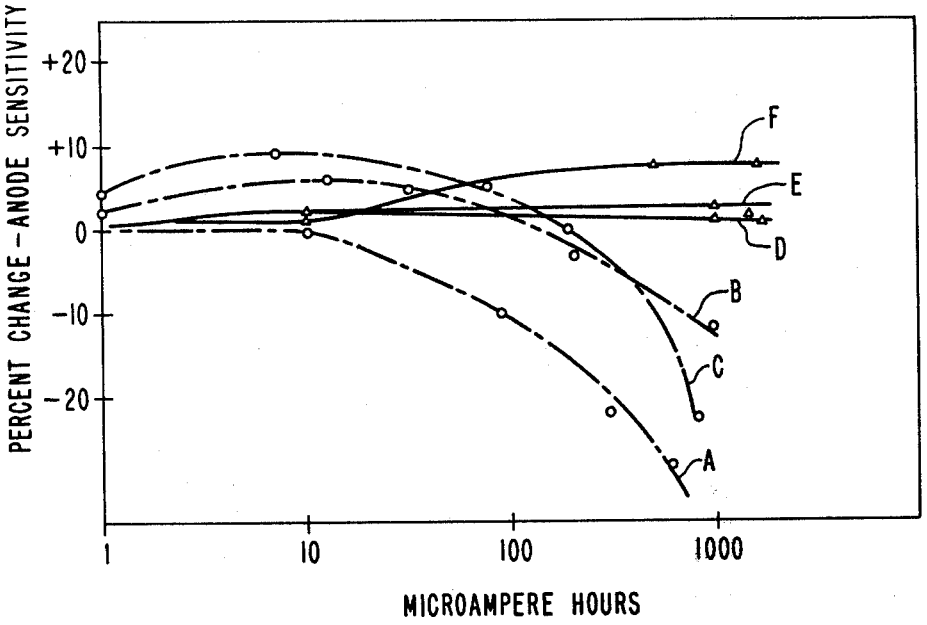
FIG. 5 is a graph showing the change in anode sensitivity as a function of anode current and time for two sets of tubes, each set having beryllium-copper dynodes with Nichrome dynodes immediately adjacent to the anode, half of the tubes being post processed by the present method and half being only aged.

Referring to the anode stability curves of FIG. 5, each of the six curves represent modified 4879A tubes having Nichrome dynodes 46 and 47 with standard beryllium-copper dynodes 32 and 40–45. The primary dynode 22 comprises the improved secondary emission surface described in the copending Faulkner et al. application Ser. No. 132,659 filed Mar. 21, 1980.

All the tubes were similarly cathode processed; however, the post-exhaust processing of the tubes represented by curves A, B, and C did not include the step of differential baking. However, these tubes were aged as described herein. The tubes represented by the curves D, E, and F were differentially baked and aged by the present method described herein. As shown in FIG. 5, the tubes represented by curves D, E, and F demonstrate anode stability ranging from 1 to about 7 percent after 2000 microampere hours of operation; whereas, the tubes A, B and C which were only aged and not differential baked show a decrease in anode sensitivity ranging from about 13.5 to greater than 30 percent after about 1000 microampere hours.

GENERAL CONSIDERATIONS

In an effort to explain the variations in anode sensitivity as a function of post-exhaust processing, the secondary emission gain of each individual dynode was measured for tubes B,C,D,E, and F whose anode sensitivity change was recorded in FIG. 5. The secondary emission gains of the dynodes of tube A, which showed the greatest decrease in anode sensitivity in FIG. 5, were not determined since it was thought that the results for tube A might not be representative.

In tables I and II the individual gain value for each of the dynodes one through ten for tubes B and C and for tubes D, E, and F, respectively, is recorded at the beginning of the stability test period and at the termination of the stability test. The individual gain values are listed in the columns labeled, $\delta_i$, pre-stability gain and, $\delta_i'$, post stability gain, respectively. Since the anode sensitivity is defined as the product of the photocathode sensitivity, S, and the product of the individual dynodes gains, i.e., $$S \times \prod_{i=1}^{N} \delta_i,$$

it follows that the multiplier gain at the beginning of the stability test $$\left(\prod_{i=1}^{10} \delta_i\right)$$

and at the termination of the stability test $$\left(\prod_{i=1}^{10} \delta_i'\right)$$

is directly proportional to the anode sensitivity and can be calculated for tubes B,C,D,E and F. Likewise, the predicted percent change in multiplier gain can be calculated for each of the tubes by the relationship $$\frac{\prod_{i=1}^{10} \delta_i' - \prod_{i=1}^{10} \delta_i}{\prod_{i=1}^{10} \delta_i} \times 100 = \Delta_c\% \quad (1)$$

The predicted change in multiplier gain can be compared with the actual percent change in anode sensitivity shown in FIG. 5. Any variation between the predicted change and the actual change is due to changes in the photocathode sensitivity of the tube, and, or, to measurement errors.

The effect of dynode material and post-exhaust processing on secondary emission gain and thus on anode sensitivity can be determined by calculating the secondary emission gain product for the beryllium-copper based dynodes one through eight and for the Nichrome dynodes nine and ten. The gain product of the first eight dynodes of each tube can be determined by forming the product of the individual gains both before and after stability testing. The calculated pre-stability test product of dynodes one through eight, represented by the notation $\delta_1 \ldots \delta_8$ is recorded for each tube in column two of table III. Likewise, the post stability test gain product of the first eight dynodes, represented by the notation $\delta_1' \ldots \delta_8'$ is recorded in column three of table III. The gain product of the ninth and tenth dynodes comprising Nichrome dynodes 46 and 47 is denoted by the representative $\delta_9 \cdot \delta_{10}$ for the pre-stability test product and by $\delta_9' \cdot \delta_{10}'$ for the post stability test product in columns four and five, respectively, of table III. The sixth and seventh columns of table III contain the aforementioned calculated multiplier gain at the beginning of the stability test, $$\prod_{i=1}^{10} \delta_i,$$

and the calculated multiplier gain, $$\prod_{i=1}^{10} \delta_i',$$

at the termination of the stability test. The eighth column contains the calculated percent change $\Delta_c\%$ in multiplier gain using equation (1) and the ninth column of table III contains the actual percent change, $\Delta_A\%$, of anode sensitivity from FIG. 5.

With reference to table III, in tubes B and C, which were aged but not differentially baked, the gain product of the beryllium-copper dynodes $\delta_1' \ldots \delta_8'$ and the gain product of the Nichrome dynodes $\delta_9' \cdot \delta_{10}'$, shows a decrease in value at the termination of the stability test period. Specifically, for tube B, the gain product of the beryllium-copper dynodes at the beginning of the stability test, $\delta_1 \ldots \delta_8$, is 19,127.23. The beryllium-copper dynode gain product at the termination of the stability test, $\delta_1' \ldots \delta_8'$, has decreased to 18,944.52 for a decrease of 9.6 percent. The gain product of the ninth and tenth Nichrome dynodes also has decreased from a pre-stability test product value, $\delta_9 \cdot \delta_{10}$, of 2.95 to a post stability test product value, $\delta_9' \cdot \delta_{10}'$, of 2.63. The decrease in Nichrome dynode product gain totals 10.84 percent. Since the overall calculated decrease in multiplier gain for tube B, i.e. $\Delta_c\%$, is $-11.6$ percent, the decrease in the post stability gain product for both the beryllium-copper dynodes and the Nichrome dynodes is additive.

TABLE I

| Tube B | | | Tube C | | |
|---|---|---|---|---|---|
| Dynode No. | $\delta_i$ | $\delta_i'$ | Dynode No. | $\delta_i$ | $\delta_i'$ |
| 1 | 10.28 | 7.79 | 1 | 10.13 | 9.18 |
| 2 | 3.57 | 4.36 | 2 | 3.73 | 4.10 |
| 3 | 3.44 | 3.60 | 3 | 3.45 | 3.58 |
| 4 | 2.30 | 2.39 | 4 | 2.31 | 2.29 |
| 5 | 2.49 | 2.55 | 5 | 2.46 | 2.23 |
| 6 | 2.83 | 2.78 | 6 | 2.49 | 2.53 |
| 7 | 2.85 | 2.84 | 7 | 2.58 | 2.45 |
| 8 | 3.28 | 3.22 | 8 | 3.33 | 3.06 |
| 9 | 1.81 | 1.71 | 9 | 1.73 | 1.68 |
| 10 | 1.63 | 1.54 | 10 | 1.65 | 1.57 |

TABLE II

| Tube D | | | Tube E | | | Tube F | | |
|---|---|---|---|---|---|---|---|---|
| Dynode No. | $\delta_i$ | $\delta_i'$ | Dynode No. | $\delta_i$ | $\delta_i'$ | Dynode No. | $\delta_i$ | $\delta_i'$ |
| 1 | 10.29 | 9.53 | 1 | 10.72 | 9.19 | 1 | 10.20 | 8.67 |
| 2 | 2.66 | 2.83 | 2 | 2.60 | 3.01 | 2 | 3.00 | 3.19 |
| 3 | 3.04 | 3.00 | 3 | 2.97 | 3.01 | 3 | 3.07 | 3.12 |
| 4 | 2.35 | 2.45 | 4 | 2.20 | 2.37 | 4 | 2.34 | 2.46 |
| 5 | 2.46 | 2.59 | 5 | 2.51 | 2.54 | 5 | 2.41 | 2.47 |
| 6 | 2.54 | 2.56 | 6 | 2.39 | 2.44 | 6 | 2.45 | 2.54 |
| 7 | 2.70 | 2.85 | 7 | 2.68 | 2.75 | 7 | 2.66 | 2.78 |
| 8 | 3.12 | 3.24 | 8 | 3.08 | 3.12 | 8 | 3.13 | 3.24 |
| 9 | 1.67 | 1.65 | 9 | 1.73 | 1.68 | 9 | 1.77 | 1.79 |
| 10 | 1.65 | 1.54 | 10 | 1.70 | 1.62 | 10 | 1.64 | 1.62 |

TABLE III

| Tube | $\delta_1 \ldots \delta_8$ | $\delta_1' \ldots \delta_8'$ | $\delta_9 \cdot \delta_{10}$ | $\delta_9' \cdot \delta_{10}'$ | $\prod_{i=1}^{10} \delta_i$ | $\prod_{i=1}^{10} \delta_i'$ | $\Delta_c\%$ | $\Delta_A\%$ |
|---|---|---|---|---|---|---|---|---|
| B | 19,127.23 | 18,944.52 | 2.95 | 2.63 | 56,431.07 | 49,888.49 | −11.6 | −11.5 |
| C | 15,847.03 | 13,051.43 | 2.85 | 2.64 | 45,235.33 | 34,424.44 | −23.9 | −23.6 |
| D | 10,292.61 | 12,136.58 | 2.76 | 2.54 | 28,361.29 | 30,839.05 | 8.7 | 1.0 |
| E | 9,021.24 | 10,493.19 | 2.94 | 2.72 | 26,521.58 | 28,558.28 | 7.7 | 2.0 |
| F | 10,806.49 | 11,995.55 | 2.90 | 2.90 | 31,369.68 | 34,784.68 | 10.9 | 8.0 |

This value is in good agreement with the actual change $\Delta_A\%$ in anode sensitivity which is a decrease of 11.5 percent.

For tube D, E and F, of table III, which were differentially baked and aged by the present novel method, it should be noted that the post stability gain product for the beryllium-copper dynodes, $\delta_1' \ldots \delta_8'$ increases in each instance over the pre-stability test gain product, $\delta_1 \ldots \delta_8$; however, this increase is generally offset by a decrease in the post stability test gain product of the Nichrome dynodes, $\delta_9' \cdot \delta_{10}'$. Thus the overall increase in gain experienced by the first eight beryllium-copper dynodes is balanced by the decrease in the gain of the Nichrome dynodes resulting in an unexpected improvement in anode stability for differentially baked and aged tubes having two Nichrome dynodes adjacent to the anode.

It may be observed from Table III that a tradeoff exists in the use of the present novel method. Tubes D, E and F show a lower pre-stability gain product, $\delta_1 \ldots \delta_8$, for the beryllium-copper dynodes and a lower pre-stability multiplier gain, $$\prod_{i=1}^{10} \delta_i,$$

than do tubes B and C. These lower values are believed to be due to the differential bake step which removes excess alkali material from the active surface of the dynodes. Even though the differential bake concentrates the greatest amount of heat in the vicinity of the anode 48 and the ninth and tenth dynodes 46 and 47, respectively, the resulting temperature gradient is sufficient to heat the beryllium-copper dynodes of the array 38 in a beneficial manner to produce the aforedescribed balance in dynode gain. It is also believed that subsequent to the differential bake step the aging steps act in an unknown fashion to rearrange or rebind the remaining loosely bound alkali material to the dynode surface to provide the necessary anode sensitivity stability.

What is claimed is:

1. A method of stabilizing the anode sensitivity of a photomultiplier tube, having a photocathode, an anode and a plurality of dynodes for propagating and concatenating electron emission from said photocathode to said anode, each of said plurality of dynodes comprising a supporting substrate having a secondary emissive material on an exposed surface thereof, and at least one Nichrome dynode adjacent to said anode, comprising the steps of:

establishing a temperature gradient across said plurality of dynodes so that the temperature of said Nichrome dynode is substantially greater than said photocathode;

bright aging said tube at a first voltage for a predetermined period of time with the photocathode illuminated; and then dark aging said tube at a second voltage for a second predetermined period of time with said photocathode non-illuminated.

2. The method as in claim 1 wherein the temperature of said Nichrome dynode and said anode during said step of establishing a temperature gradient is between about 175° C. and about 225° C. and the temperature of said photocathode is about 125° C.

3. The method as in claim 2 wherein said temperature gradient is maintained for between about 20 to 25 minutes.

4. The method as in claim 1 wherein said anode is operated at about 10 to 50 microamperes during bright aging and said first voltage is about 1100 volts.

5. The method as in claim 4 wherein said bright aging is continued for about 4 hours.

6. The method as in claim 1 wherein said dark aging is continued for about 8 to 12 hours and said second voltage is about 1600 volts.

7. A method of stabilizing the anode sensitivity of a photomultiplier tube having a plurality of tube elements, including a photocathode, an anode and an electron multiplier comprising a plurality of beryllium-copper dynodes, each of said beryllium-copper dynodes having a beryllium oxide secondary emissive surface, and at least one Nichrome dynode adjacent to said anode, said nichrome dynode having an exposed surface substantially devoid of secondary emissive material, comprising the steps of:

(a) differentially heating said tube so that the temperature of said Nichrome dynode and said anode is substantially greater than the temperature of said photocathode thereby establishing a temperature gradient across said electron multiplier;

(b) cooling said tube to approximately room temperature;

(c) energizing said tube elements with a plurality of first voltages, each of said voltages increasing in magnitude from said photocathode to said anode so that electrons emitted from said photocathode will be propagated and concatenated from said photocathode to said anode;

(d) illuminating said photocathode of said tube for a first predetermined period of time while said tube elements are energized so as to obtain a predetermined anode current;

(e) with the illumination removed from said photocathode, increasing the magnitude of said plurality of first voltages to a plurality of second predetermined voltages; and (f) de-energizing the elements of said tube after a second predetermined period of time.

8. The method as in claim 7 wherein the temperature of said Nichrome dynode and said anode during said step of differentially heating is between about 175° C. and 225° C. and the temperature of said photocathode is about 125° C., said heating being maintained for between about 20 to 25 minutes.

9. The method as in claim 7 wherein the photocathode is illuminated for about 4 hours so as to obtain about 10 to 50 microamperes of anode current.

10. The method as in claim 7 wherein the second predetermined period of time is about 8 to 12 hours.

* * * * *